US010248054B2

(12) United States Patent
Ogasawara

(10) Patent No.: US 10,248,054 B2
(45) Date of Patent: Apr. 2, 2019

(54) FUSER HAVING RESIN FRAME AND METAL FRAME

(71) Applicant: Brother Kogyo Kabushiki Kaisha, Nagoya-shi, Aichi-ken (JP)

(72) Inventor: Tatsuo Ogasawara, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/840,229

(22) Filed: Dec. 13, 2017

(65) Prior Publication Data

US 2018/0164724 A1 Jun. 14, 2018

(30) Foreign Application Priority Data

Dec. 14, 2016 (JP) ..... 2016-242121

(51) Int. Cl.
*G03G 15/20* (2006.01)
*G03G 21/16* (2006.01)

(52) U.S. Cl.
CPC ..... *G03G 15/2017* (2013.01); *G03G 15/2053* (2013.01); *G03G 21/1685* (2013.01); *G03G 21/1619* (2013.01)

(58) Field of Classification Search
CPC ..... G03G 15/2017; G03G 15/2053; G03G 21/1685; G03G 21/1619
See application file for complete search history.

(56) References Cited

U.S. PATENT DOCUMENTS

| | | | | |
|---|---|---|---|---|
| 6,266,502 | B1 | 7/2001 | Matsuzaki et al. | |
| 8,971,778 | B2 | 3/2015 | Suzuki et al. | |
| 2009/0220263 | A1* | 9/2009 | Murayama | G03G 15/0194 399/49 |
| 2013/0071155 | A1 | 3/2013 | Suzuki et al. | |
| 2014/0233995 | A1* | 8/2014 | Kasuya | G03G 15/2053 399/329 |
| 2015/0153692 | A1* | 6/2015 | Matsubara | G03G 15/2042 399/329 |

FOREIGN PATENT DOCUMENTS

| | | | |
|---|---|---|---|
| JP | S62-289877 | A | 12/1987 |
| JP | 2000-132039 | A | 5/2000 |
| JP | 2007-147690 | A | 6/2007 |
| JP | 2013-068660 | A | 4/2013 |

* cited by examiner

*Primary Examiner* — Rodney A Bonnette
(74) *Attorney, Agent, or Firm* — Banner & Witcoff, Ltd.

(57) ABSTRACT

A fuser includes: a rotating body; a roller configured to convey a sheet in a conveyance direction; a pair of bearings supporting the roller; one side frame made of a resin, supporting one of the pair of bearings; another side frame supporting the other of the pair of bearings, and arranged at a distance from the one side frame in the axial direction; and a center frame made of a metal, including a main-body portion arranged on an opposite side of the rotating body with respect to the roller. One end portion in the axial direction of the main-body portion includes a first fixing portion which is fixed to the one side frame, and a second fixing portion which is arranged on an upstream side of the first fixing portion in the conveyance direction, and is fixed to the one side frame.

20 Claims, 7 Drawing Sheets

FUSER HAVING RESIN FRAME AND METAL FRAME

CROSS REFERENCE TO RELATED APPLICATION

The present application claims priority from Japanese Patent Application No. 2016-242121 filed on Dec. 14, 2016, the disclosures of which is incorporated herein by reference in its entirety.

BACKGROUND OF THE INVENTION

Field of the Invention

The present invention relates to a fuser which includes a resin frame.

Description of the Related Art

In fusers used in image forming apparatuses, a fuser which includes a rotating body, a roller which conveys a sheet between the rotating body and the roller, and a frame which supports the roller has heretofore been known. For instance, in a fuser disclosed in Japanese Patent Application Laid-open Publication No. 2013-068660 corresponding to US Patent Application Publication No. 2013/0071155, a frame includes a pair of side walls arranged on both sides in an axial direction of the roller, and a bottom wall portion which connects the pair of side walls. Moreover, the frame is made of a resin. By such frame being formed of a resin, it is easier to prepare a complex shape of a portion supporting the roller, as compared to a case in which the frame is formed of a sheet metal.

SUMMARY OF THE INVENTION

According to an aspect of the present teaching, there is provided a fuser including: a rotating body; a roller having a rotational axis extended in an axial direction, configured to convey a sheet in a conveyance direction which is perpendicular to the axial direction in a state of nipping the sheet between the rotating body and the roller; a pair of bearings supporting the roller; one side frame made of a resin, supporting one of the pair of bearings; another side frame supporting the other of the pair of bearings, and arranged at a distance from the one side frame in the axial direction; and a center frame made of a metal, including a main-body portion arranged on an opposite side of the rotating body with respect to the roller. One end portion in the axial direction of the main-body portion includes a first fixing portion which is fixed to the one side frame, and a second fixing portion which is arranged on an upstream side of the first fixing portion in the conveyance direction, and is fixed to the one side frame.

DETAILED DESCRIPTION OF THE PREFERRED EMBODIMENTS

Figure 1:
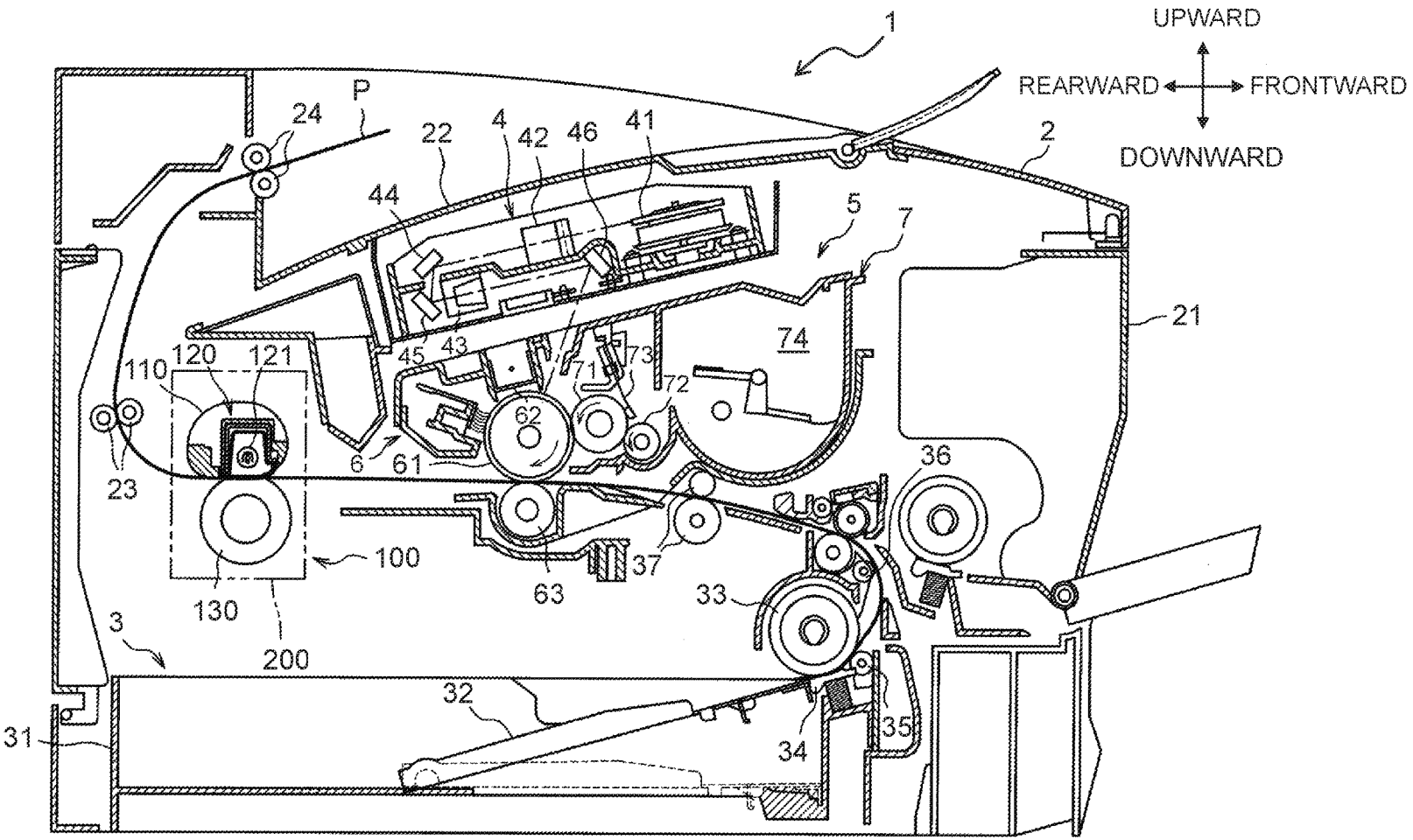
FIG. 1 is a diagram showing a schematic arrangement of a laser printer which includes a fuser according to an embodiment of the present teaching.

Next, an embodiment of the present teaching will be described below in detail while appropriately referring to the accompanying diagrams. In the following description, to start with, an arrangement in detail of a fuser 100 will be described below after describing a schematic arrangement of a laser printer 1 which includes the fuser 100 according to the embodiment. Moreover, in the following description, directions will be described with a user who uses the laser printer 1, as a reference. Specifically, a right side of FIG. 1, which is a frontward side as viewed from the user is let to be 'frontward', a left side of FIG. 1 which is an inner side as viewed from the user is let to be 'rearward', a frontward side of a paper surface of FIG. 1 is let to be 'leftward', and an inner side of the paper surface is let to be 'rightward'. Moreover, a vertical direction (upward-downward direction) of FIG. 1 is let to be 'upward-downward'.

As shown in FIG. 1, the laser printer 1 mainly includes, inside a main-body casing 2, a paper feeding section 3 which supplies a paper P as an example of a sheet, an exposing unit 4, a process cartridge 5 which transfers a toner image on to the paper P, and the fuser 100 which fixes the toner image on the paper P by thermal fixing.

The paper feeding section 3 is provided at a lower portion inside the main-body casing 2. The paper feeding section 3 includes mainly a paper feeding tray 31 which accommodates the paper P, a paper pressing plate 32 which lifts up a front side of the paper P, a paper feeding roller 33, a paper feeding pad 34, paper-dust removing rollers 35 and 36, a registering (registration, resist) roller 37. The papers P in the paper feeding tray 31 are gathered to the paper feeding roller 33 by the paper pressing plate 32, and are separated one by one by the paper feeding roller 33 and the paper feeding pad 34, and conveyed toward the process cartridge 5 upon passing over the paper-dust removing rollers 35 and 36, and the registering roller 37.

The exposing unit 4 is arranged at an upper portion inside the main-body casing 2. The exposing unit 4 includes mainly a laser-emitting portion (section) which is not shown in the diagram, a polygon mirror 41 which is driven to rotate, lenses 42 and 43, and reflecting mirrors 44, 45, and 46. In the exposing unit 4, laser light (refer to dot-dashed lines) based on image data, emerged from the laser-emitting portion, upon reflecting at or passing through the polygon mirror 41, the lens 42, the reflecting mirrors 44 and 45, the lens 43, and the reflecting mirror 46, is subjected to high-speed scanning on a surface of a photosensitive (photoconductor, photoreceptor) drum 61 that will be described later.

The process cartridge 5 is arranged at a lower side of the exposing unit 4, and is detachably installed on the main-body casing 2 through an opening which is formed when a front cover 21 provided to the main-body casing 2 is opened. The process cartridge 5 includes a drum unit 6 and a developing unit 7.

The drum unit 6 includes mainly the photosensitive drum 61, a charger 62, and a transfer roller 63. Moreover, the developing unit 7 is detachably mounted on the drum unit 6, and includes a developing roller 71, a feed (supply) roller 72, a layer-thickness regulating blade 73, and a toner accommodating section 74 which accommodates a toner.

In the process cartridge 5, a surface of the photosensitive drum 61 is exposed by a high-speed scanning by laser light from the exposing unit 4 after being charged uniformly by the charger 62. Accordingly, an electrostatic latent image based on image data is formed on the photosensitive drum 61. Moreover, the toner in the tonner accommodating section 74 is supplied to the developing roller 71 via the feed (supply) roller 72, and upon entering between the developing roller 71 and the layer-thickness regulating blade 73, is carried on the developing roller 71 as a thin layer having a uniform thickness.

The toner carried on the developing roller 71 is fed (supplied) from the developing roller 71 to the electrostatic latent image formed on the photosensitive drum 61. Accordingly, the electrostatic latent image becomes a visible image, and a toner image is formed on the photosensitive drum 61. Thereafter, by the paper P being conveyed between the photosensitive drum 61 and the transfer roller 63, the toner image on the photosensitive drum 61 is transferred on to the paper P.

The fuser 100 is provided to a rear side of the process cartridge 5. The toner image transferred on to the paper P is subjected to thermal fixing on the paper P by passing through the fuser 100. The paper P having the toner image fixed thereon by thermal fixing is discharged to a paper discharge tray 22 by conveying rollers 23 and 24.

The fuser 100 includes a fixing belt 110 as an example of the rotating body, a heating unit 120, a pressurizing roller 130 as an example of the roller, and a fixing frame 200.

The fixing belt 110 is an endless belt which is heat resistant and flexible. The heating unit 120 is arranged at an inner side of the fixing belt 110. The heating unit 120 includes a heater 121, and heats the fixing belt 110. The heating unit 120 is supported by the fixing frame 200. The pressurizing roller 130 is a roller which rotates around an axis (axis of rotation 131A, refer to FIG. 5), as a center, extended in a leftward-rightward direction (an example of the 'axial direction') arranged at a lower side of the fixing belt 110. In other words, in the present embodiment, an alignment direction in which the fixing belt 110 and the pressurizing roller 130 are aligned is the vertical direction (upward-downward direction). The pressurizing roller 130 is a roller which conveys the paper P between the fixing belt 110 and the pressurizing roller 130 from the front to the rear, and forms a nip between the fixing belt 110 and the pressurizing roller 130. In the following description, a frontward-rearward direction in which the paper P passing through between the fixing belt 110 and the pressurizing roller 130 is conveyed is also referred to as a 'conveyance direction (direction of transporting)'. Moreover, in the present embodiment, an upstream side of the conveyance direction of the paper P passing between the fixing belt 110 and the pressurizing roller 130 is a 'front side', and an downstream side of the conveyance direction of the paper P is a 'rear side'. In the present embodiment, the 'conveyance direction' which is the frontward-rearward direction, is perpendicular to the 'axial direction' which is the leftward-rightward direction, and the 'alignment direction' is perpendicular to the 'axial direction' and the 'conveyance direction'.

Figure 2:
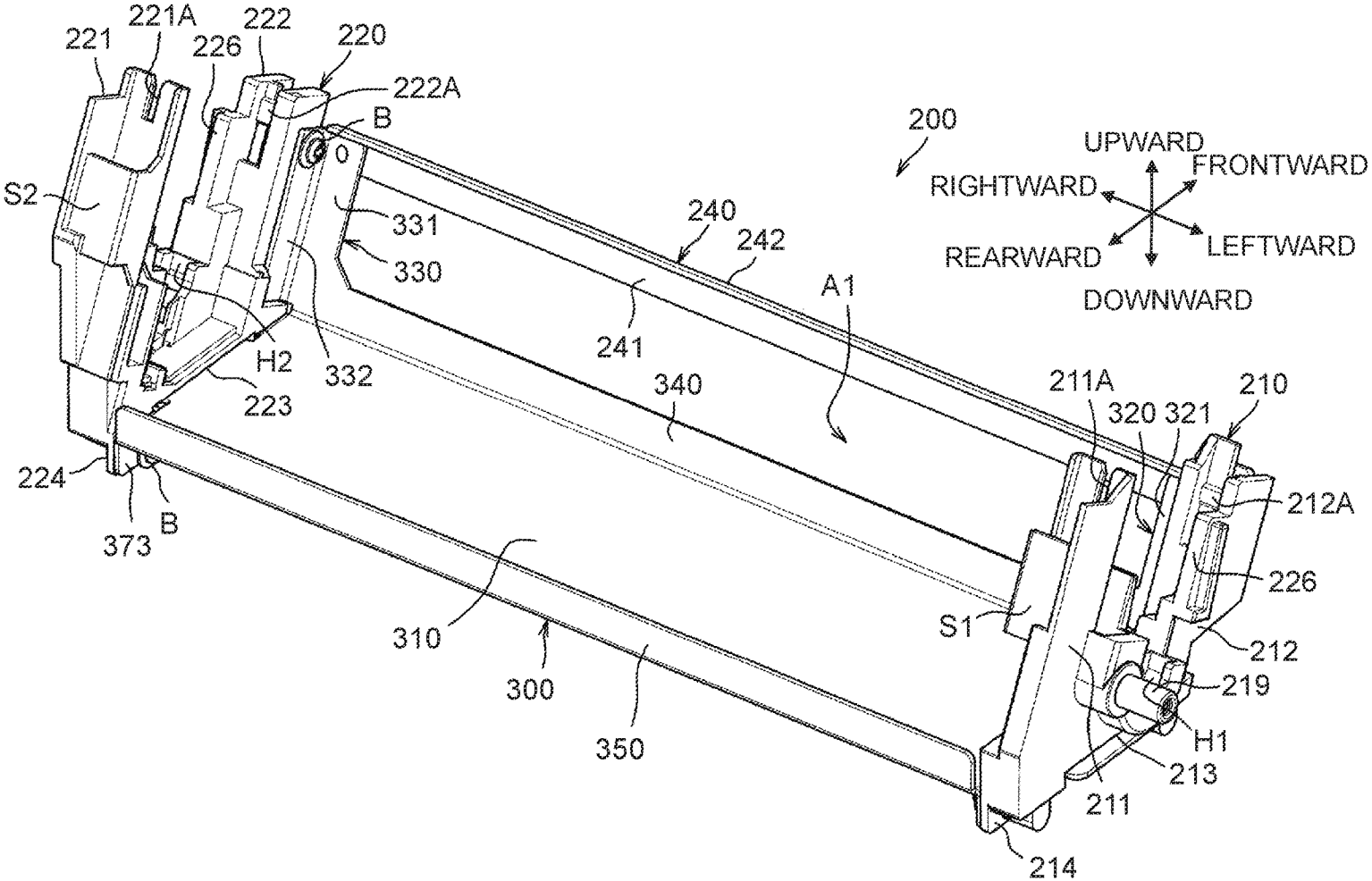
FIG. 2 is a perspective view showing a fixing frame.

The fixing frame 200, as shown in FIG. 2, includes a resin frame 210, a resin frame 220, a metal frame 300, and a connecting member 240. The resin frame 210 or the resin frame 220 is an example of the 'one side frame' and the metal frame 300 is an example of the 'center frame'.

The resin frame 210 and the resin frame 220 are frames which form side walls on left and right of the fixing frame 200, and are made of a heat-resistant resin. For instance, a material of the resin frame 210 and the resin frame 220 may be PET (polyethylene terephthalate), or may be an LCP (liquid crystal polymer). Moreover, filler such as glass fiber and glass beads may be filled up in the resin frame 210 and the resin frame 220. The resin frame 220 is arranged at a distance in the leftward-rightward direction as an example of the axial direction from the resin frame 210, and is positioned on a right side of the resin frame 210.

The resin frame 210 includes a rear portion 211, a front portion 212 which is arranged at a distance from the front portion, on a front side of the rear portion 211, and a lower portion 213 which connects lower-end portions of the rear portion 211 and the front portion 212, and is formed to be substantially U-shaped. The resin frame 210 includes a boss 219 having a circular cylindrical shape protruding outward in the leftward-rightward direction (direction away from the resin frame 220, in the leftward-rightward direction) on the rear portion 211.

The resin frame 220 includes a rear portion 221, a front portion 222 which is arranged at a distance from the rear portion 221 on a front side of the rear portion 221, and a lower portion 223 which connects lower-end portions of the rear portion 221 and the front portion 222, and is formed to be substantially U-shaped.

The metal frame 300 is made of a metal plate. For instance, the metal frame 300 is a frame made of a metal such as stainless steel and an aluminum alloy. A surface of the metal frame 300 may have an oxide film (layer) of a metal formed thereon, or may have been coated with a non-metal film. The metal frame 300 has a rigidity higher than a rigidity of the resin frame 210 and the resin frame 220. Moreover, the metal frame 300 has a coefficient of linear expansion smaller than that of the resin frame 210 and the resin frame 220. Furthermore, the metal frame 300 has Young's modulus larger (higher) that Young's modulus for the resin frame 210 and the resin frame 220.

Figure 3:
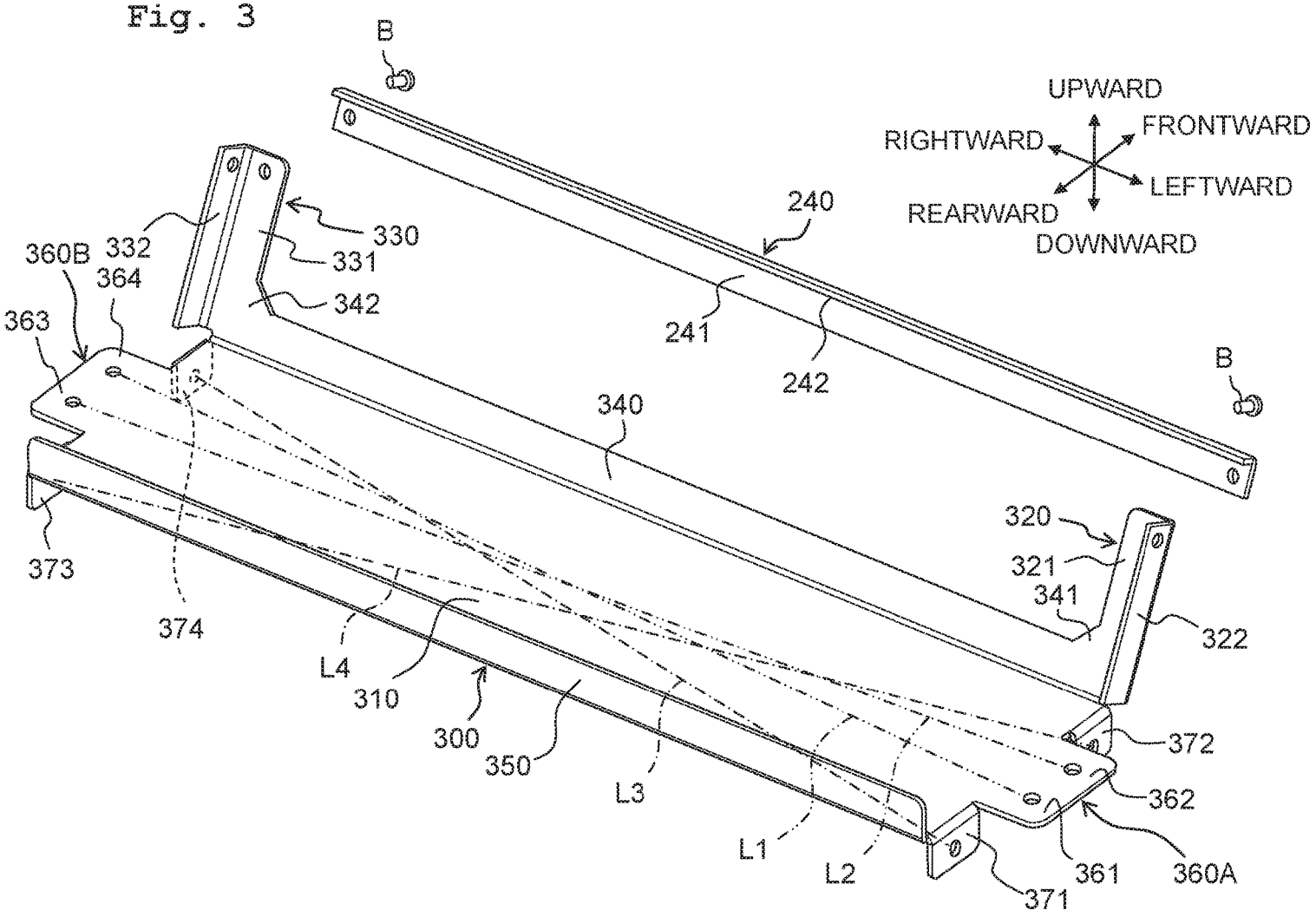
FIG. 3 is an exploded perspective view showing a metal frame and a connecting member.

The metal frame 300 connects the resin frame 210 and the resin frame 220. The metal frame 300, as shown in FIG. 3, includes integrally, a main-body portion 310 having a rectangular shape long in the leftward-rightward direction, a reinforcing portion 320, a reinforcing portion 330, and a front reinforcing portion 340 that are provided to a front-end portion of the main-body portion 310, and a rear reinforcing portion 350 which is provided to a rear-end portion of the main-body portion 310.

The reinforcing portion 320 is an example of the first reinforcing portion. The reinforcing portion 320 is continuous from a left-end portion which is an end portion in the leftward-rightward direction of the front end of the main-body portion 310, and is extended in a direction directed from the pressurizing roller 130 toward the fixing belt 110, or in other words, is extended upward. The reinforcing portion 320 is formed to be L-shaped when viewed from the vertical direction. Specifically, the reinforcing portion 320 includes a reinforcing plate portion 321 which faces the frontward-rearward direction and which is long in the vertical direction, and a fixing (fixed) plate portion 322 which is extended toward the rear side from a left end of the reinforcing plate portion 321.

The reinforcing portion 330 is an example of the second reinforcing portion. The reinforcing portion 330 is continuous from a right-end portion which is the other end portion in the leftward-rightward direction of the front end of the main-body portion 310, and is extended in a direction directed from the pressurizing roller 130 toward the fixing belt 110, or in other words, is extended upward. The reinforcing portion 330 is formed to be L-shaped when viewed from the vertical direction. Specifically, the reinforcing portion 330 includes a reinforcing plate portion 331 which faces the frontward-rearward direction and which is long in the vertical direction, and a fixing plate portion 332 which is extended toward the rear side from a right end of the reinforcing plate portion 331.

The front reinforcing portion 340 is an example of the third reinforcing portion, and is continuous from a front end of the main-body portion 310 and is extended upward. In other words, the front reinforcing portion 340 is extended from the front end of the main-body portion 310 toward the fixing belt 110, in the vertical direction in which the fixing belt 110 and the pressurizing roller 130 are aligned. The front reinforcing portion 340 has a dimension in the vertical direction smaller than dimensions of the reinforcing portion 320 and the reinforcing portion 330, and is extended to be long in the leftward-rightward direction to connect lower ends of the reinforcing portion 320 and the reinforcing portion 330. In other words, the front reinforcing portion 340 connects the reinforcing portion 320 and the reinforcing portion 330.

For reinforcing the reinforcing portion 320 and the reinforcing portion 330, a corner of the reinforcing portion 320 and the front reinforcing portion 340, and a corner of a reinforcing portion 330 and the front reinforcing portion 340 are provided with inclined portions 341 and 342 respectively. The inclined portion 341 between the front reinforcing portion 340 and the reinforcing portion 320 connects a lower-end portion of a right end of the reinforcing plate portion 321 and a left-end portion of an upper end of the front reinforcing portion 340. The inclined portion 342 between the front reinforcing portion 340 and the reinforcing portion 330 connects a lower-end portion of a left end of the reinforcing plate portion 331 and a right-end portion of an upper end of the front reinforcing portion 340.

The rear reinforcing portion 350 is an example of the third reinforcing portion, and is extended upward continuously from a rear-end portion of the main-body portion 310. In other words, the rear reinforcing portion 350 is extended toward the fixing belt 110 from an end portion in the conveyance direction of the main-body portion 310, in the direction in which the fixing belt 110 and the pressurizing roller 130 are aligned. The rear reinforcing portion 350 is provided throughout from a left end up to a right end of the main-body portion 310. A dimension in the vertical direction of the rear reinforcing portion 350 is almost same as a dimension in the vertical direction of the front reinforcing portion 340.

The main-body portion 310 has a surface facing the pressurizing roller 130. The metal frame 300 further includes the third reinforcing portion (the front reinforcing portion 340 and the rear reinforcing portion 350) which is extended from at least one of both end portions (front-end portion and rear-end portion) in the conveyance direction of the surface of the main-body portion 310 toward a side same as the fixing belt 110 (upper side) with respect to the surface of the main-body portion 310. In the present embodiment, the metal frame 300 includes both of the front reinforcing portion 340 and the rear reinforcing portion 350 as the third reinforcing portion. However, the metal frame 300 may include any one of the front reinforcing portion 340 and the rear reinforcing portion 350 as the third reinforcing portion. The third reinforcing portion (the front reinforcing portion 340 and the rear reinforcing portion 350) has a plate shape and is extended in the leftward-rightward direction, along two end portions (front-end portion and rear-end portion) in the conveyance direction of the surface of the main-body portion 310.

The main-body portion 310 includes, at a left-end portion which is one end portion in the leftward-rightward direction, a vertical fixing portion (longitudinal fixing portion) 361, a vertical fixing portion (longitudinal fixing portion) 362, a horizontal fixing portion (lateral fixing portion) 371, and a horizontal fixing portion (lateral fixing portion) 372 for fixing the metal frame 300 to the resin frame 210. Moreover, the main-body portion 310 includes, at a right-end portion which is the other end portion in the leftward-rightward direction, a vertical fixing portion (longitudinal fixing portion) 363, a vertical fixing portion (longitudinal fixing portion) 364, a horizontal fixing portion (lateral fixing portion) 373, and a horizontal fixing portion (lateral fixing portion) 374 for fixing the metal frame 300 to the resin frame 220.

The vertical fixing portion 361 is an example of the first fixing portion, and the vertical fixing portion 362 is an example of the second fixing portion. Each of the vertical fixing portion 361 and the vertical fixing portion 362 is formed in the form of a plate and faces the vertical direction, and is extended to be directed leftward from a left end of the main-body portion 310. The vertical fixing portion 362 is arranged at an upstream side in the conveyance direction, of the vertical fixing portion 361, or in other words, arranged at the front side. In the present embodiment, the vertical fixing portion 361 and the vertical fixing portion 362 are integrated, and form a extended portion 360A which is extended from the main-body portion 310.

The horizontal fixing portion 371 is an example of the first fixing portion, and is provided to a rear side of the vertical fixing portion 361. The horizontal fixing portion 371 is formed in the form of a plate and faces the leftward-rightward direction, and is extended from a rear-end portion of a left end of the main-body portion 310, in a downward direction which is orthogonal to the leftward-rightward direction.

The horizontal fixing portion 372 is an example of the second fixing portion, and is provided to a front side of the vertical fixing portion 362. The horizontal fixing portion 372 is formed in the form of a plate and faces the leftward-rightward direction, and is extended from a front-end portion of a left end of the main-body portion 310, in a downward direction which is orthogonal to the leftward-rightward direction. The horizontal fixing portion 372 is arranged at an upstream side in the conveyance direction, of the horizontal fixing portion 371.

The vertical fixing portion 363 is an example of the third fixing portion. The vertical fixing portion 364 is an example of the fourth fixing portion. Each of the vertical fixing portion 363 and the vertical fixing portion 364 is formed in the form of a plate and faces the vertical direction, and is extended to be directed rightward from a right end of the main-body portion 310. The vertical fixing portion 364 is provided to an upstream side in the conveyance direction, of the vertical fixing portion 363, or in other words, is provided to the front side. In the present embodiment, the vertical fixing portion 363 and the vertical fixing portion 364 are integrated, and form a extended portion 360B which is extended from the main-body portion 310.

The horizontal fixing portion 373 is an example of the third fixing portion, and is provided to a rear side of the vertical fixing portion 363. The horizontal fixing portion 373 is formed in the form of a plate and faces the leftward-rightward direction, and is extended from a rear-end portion of a right end of the main-body portion 310, in a downward direction which is orthogonal to the leftward-rightward direction.

The horizontal fixing portion 374 is an example of the fourth fixing portion, and is provided to a front side of the vertical fixing portion 364. The horizontal fixing portion 374 is formed in the form of a plate and faces the leftward-rightward direction, and is extended from a front-end portion of a right end of the main-body portion 310, in a downward direction which is orthogonal to the leftward-rightward direction. The horizontal fixing portion 374 is arranged at an upstream side in the conveyance direction, of the horizontal fixing portion 373.

A line segment L1 which connects the vertical fixing portion 361 and the vertical fixing portion 364, and a line segment L2 which connects the vertical fixing portion 362 and the vertical fixing portion 363 are intersecting when viewed from the vertical direction. Moreover, a line segment L3 which connects the horizontal fixing portion 371 and the horizontal fixing portion 374, and a line segment L4 which connects the horizontal fixing portion 372 and the horizontal fixing portion 373 are intersecting when viewed from the vertical direction.

A connecting member 240 is a metallic member which is long in the leftward-rightward direction. For instance, the connecting member 240 is made of a metal such as stainless steel and an aluminum alloy. A surface of the connecting member 240 may have an oxide film (layer) of a metal formed thereon, or may have been coated with a non-metal film. The connecting member 240 has a rigidity higher than the rigidity of the resin frame 210 and the resin frame 220. Moreover, the connecting member 240 has a coefficient of linear expansion smaller than that of the resin frame 210 and the resin frame 220. Furthermore, the connecting member 240 has Young's modulus larger (higher) than Young's modulus for the resin frame 210 and the resin frame 220.

In the present embodiment, the connecting member 240 is a rod long in the leftward-rightward direction. Moreover, the connecting member 240 is made of a metal plate which is bent, and is L-shaped when viewed from the leftward-rightward direction. The connecting member 240 includes a plate portion 241 which faces the frontward-rearward direction and which is extended in the leftward-rightward direction, and a plate portion 242 which is extended toward the rear side from an upper end of the plate portion 241, and which faces the vertical direction differing from the plate portion 241. In other words, the connecting member 240 includes the plate portion 241 having a rectangular shape extended in the leftward-rightward direction, and a plate portion 242 having a rectangular shape extended in the leftward-rightward direction. One of long sides of the plate portion 241 and one of long sides of the plate portion 242 are connected, and a pair of short sides of the plate portion 241 and a pair of short sides of the plate portion 242 are extended in mutually different directions. In the present embodiment, the direction in which the pair of short sides of the plate portion 241 is extended (vertical direction), and the direction in which the pair of short sides of the plate portion 242 is extended (frontward-rearward direction) are perpendicular.

The connecting member 240 is a beam provided between the resin frame 210 and the resin frame 220, and is fixed to the reinforcing portion 320 and the reinforcing portion 330 of the metal frame 300. Specifically, a left-end portion of the plate portion 241 in the connecting member 240 is fixed by a screw B to an upper-end portion of the reinforcing plate portion 321. Moreover, a right-end portion of the plate portion 241 in the connecting member 240 is fixed by a screw B to an upper-end portion of the reinforcing plate portion 331. Since the connecting member 240 has been fixed to the metal frame 300 in such manner, the reinforcing portion 320 connects a left-end portion of the main-body portion 310 and a left-end portion of the connecting member 240. Moreover, the reinforcing portion 330 connects a right-end portion of the main-body portion 310 and a right-end portion of the connecting member 240.

In the metal frame 300 arranged in such manner, a space A1 is enclosed (surrounded) by the reinforcing portion 320, the reinforcing portion 330, the connecting member 240, and the main-body portion 310 as shown in FIG. 2. In the present embodiment, the space A1 enclosed by the reinforcing portion 320, the reinforcing portion 330, the connecting member 240, and the front reinforcing portion 340 is formed as a space through which the paper P passing through the fixing belt 110 and the pressurizing roller 130 can pass. By providing such space A1, an arrangement is made such that the metal frame 300 and the connecting member 240 do not hinder the conveying of the paper P. Namely, the pressurizing roller 130 is configured to convey the paper P through the space A1.

Figure 4:
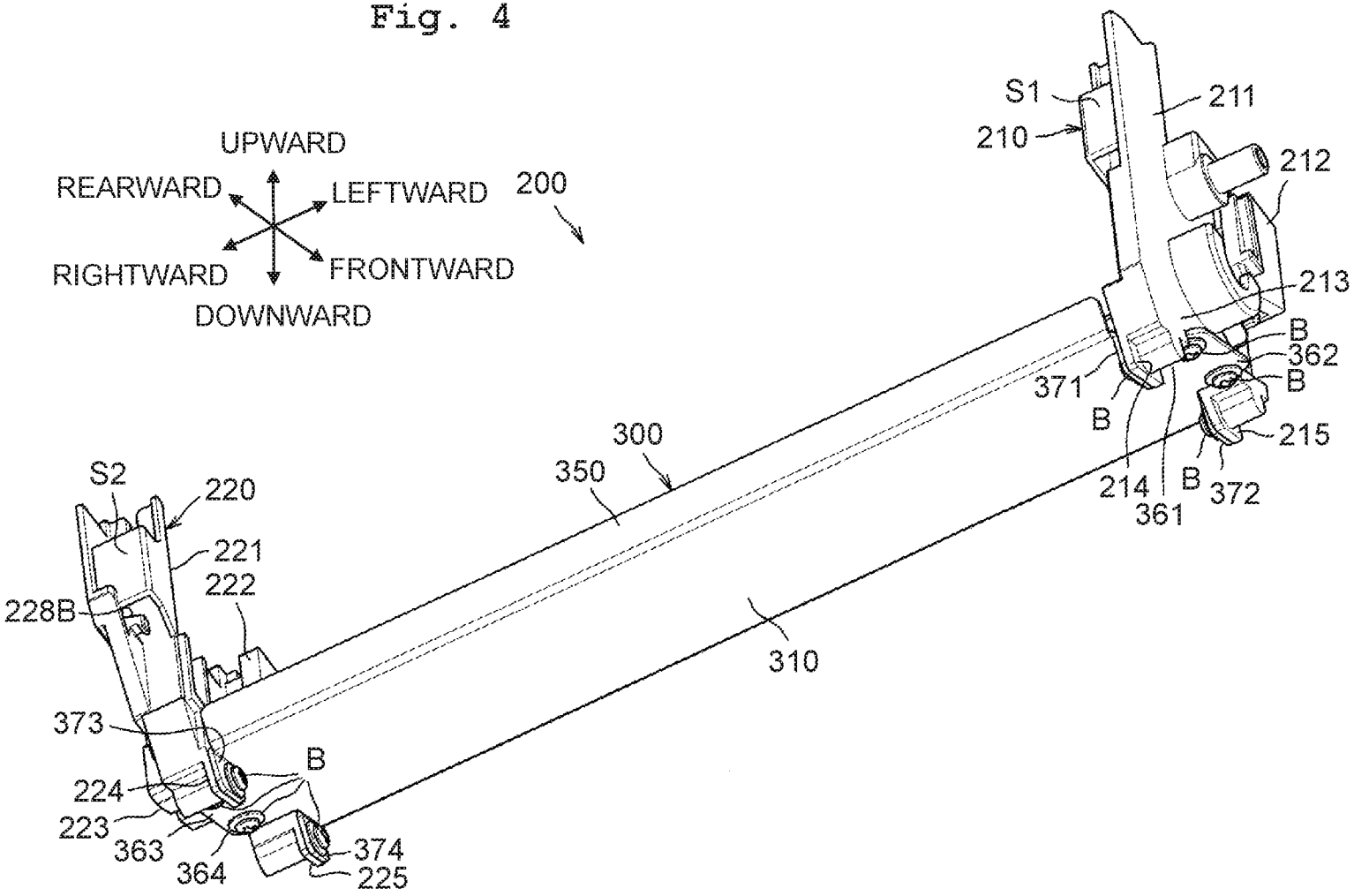
FIG. 4 is a perspective view when the fixing frame is viewed from a lower side.

Moreover, the metal frame 300 and the connecting member 240, as shown in FIG. 2 and FIG. 4, are fixed to the resin frame 210 and the resin frame 220, and connect the resin frame 210 and the resin frame 220.

As shown in FIG. 4, the resin frame 210 includes at a lower portion thereof, a metal frame fixing portion 214 and a metal frame fixing portion 215. The metal frame fixing portion 214 protrudes from the rear portion 211, in a direction directed from the fixing belt 110 toward the pressurizing roller 130, or in other words, is protruded downward, and is formed in the form of a plate and faces the leftward-rightward direction. The metal frame fixing portion 215 protrudes downward from the front portion 212, and is formed in the form of a plate and faces the leftward-rightward direction.

The resin frame 220 includes at a lower portion thereof, a metal frame fixing portion 224 and a metal frame fixing portion 225. The metal frame fixing portion 224 protrudes downward from the rear portion 221, and is formed in the form of a plate and faces the leftward-rightward direction. The metal frame fixing portion 225 protrudes downward from the front portion 222, and is formed in the form of a plate and faces the leftward-rightward direction.

The horizontal fixing portion 371 of the metal frame 300 overlaps with a surface directed toward right of the metal frame fixing portion 214 of the resin frame 210, and is fixed to the metal frame fixing portion 214 by a screw B. The horizontal fixing portion 372 overlaps with a surface directed toward right of the metal frame fixing portion 215, and is fixed to the metal frame fixing portion 215 by a screw B. In other words, the horizontal fixing portion 371 and the horizontal fixing portion 372 are fastened by screws to the resin frame 210 in the leftward-rightward direction.

The horizontal fixing portion 373 of the metal frame 300 overlaps with a surface directed toward left of the metal frame fixing portion 224 of the resin frame 220, and is fixed to the metal frame fixing portion 224 by a screw B. The horizontal fixing portion 374 overlaps with a surface directed toward left of the metal frame fixing portion 225, and is fixed to the metal frame fixing portion 225 by a screw B. In other words, the horizontal fixing portion 373 and the horizontal fixing portion 374 are fastened by screws to the resin frame 220 in the leftward-rightward direction.

Each of the vertical fixing portion 361 and the vertical fixing portion 362 of the metal frame 300 overlaps with a lower surface of the lower portion 213 of the resin frame 210, and is fixed by a screw B to the lower portion 213. In other words, the vertical fixing portion 361 and the vertical fixing portion 362 are fastened by screws to the resin frame 210 in the vertical direction, and specifically, in a direction directed from the pressurizing roller 130 toward the fixing belt 110. It is preferable that a position for fastening by screw is as much on an outer side of the frontward-rearward direction as possible. In other words, it is preferable that a distance in the frontward-rearward direction of (between) the vertical fixing portion 361 and the vertical fixing portion 362 is as long as possible.

Each of the vertical fixing portion 363 and the vertical fixing portion 364 overlaps with a lower surface of the lower portion 223 of the resin frame 220, and is fixed to the lower portion 223 by a screw B. In other words, the vertical portion 363 and the vertical portion 364 are fastened by screws to the resin frame 220 in the vertical direction, and specifically, in a direction directed from the pressurizing roller 130 toward the fixing belt 110. It is preferable that a position of fastening by screw is as much on the outer side of the frontward-rearward direction as possible. In other words, it is preferable that a distance in the frontward-rearward direction of (between) the vertical fixing portion 363 and the vertical fixing portion 364 is as long as possible.

For adjusting positions in the vertical direction of the resin frame 210 and the resin frame 220, a space may be provided between the vertical fixing portion 361 and the vertical fixing portion 362, and the lower portion 213 of the resin frame 210, or between the vertical fixing portion 363 and the vertical fixing portion 364, and the lower portion 223 of the resin frame 220.

In such manner, by the main-body portion 310 of the metal frame 300 being fixed to the resin frame 210 and the resin frame 220, the main-body portion 310 connects the resin frame 210 and the resin frame 220.

Figure 5:
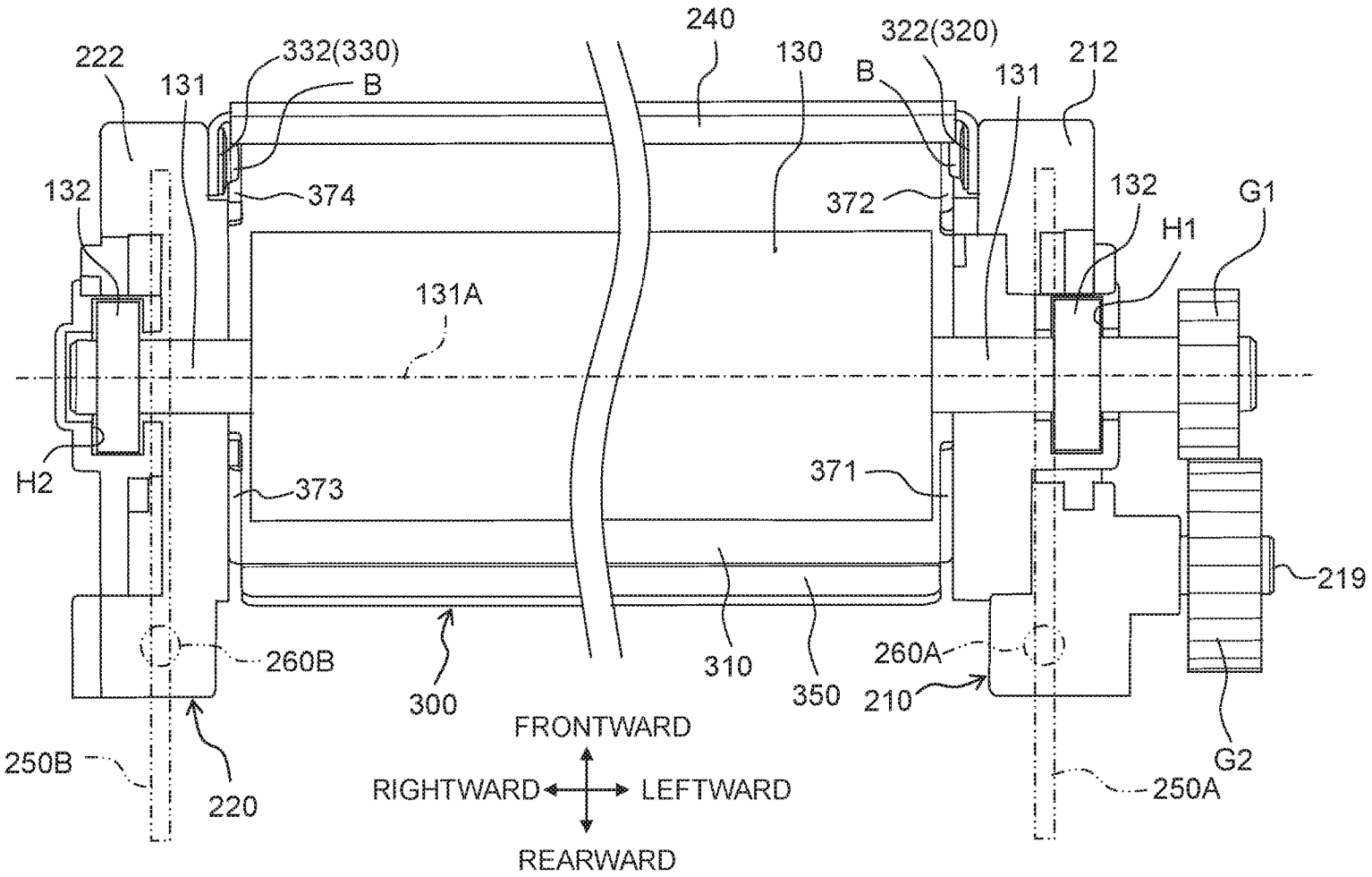
FIG. 5 is a top view showing two end portions on left and right of fixing frame in a state of supporting a pressurizing roller.

As shown in FIG. 5, the reinforcing portion 320 of the metal frame 300 is fixed to the resin frame 210. Specifically, the fixing plate portion 322 of the reinforcing portion 320 overlaps with a surface directed toward right of the front portion 212 of the resin frame 210, and is fixed to the front portion 212 by the screw B. Moreover, the reinforcing portion 330 of the metal frame 300 is fixed to the resin frame 220. Specifically, the fixing plate portion 332 of the reinforcing portion 330 overlaps with a surface directed toward left of the front portion 222 of the resin frame 220, and is fixed to the front portion 222 by the screw B. Accordingly, the connecting member 240 connects upper-end portions of the resin frame 210 and the resin frame 220 via the reinforcing portion 320 and the reinforcing portion 330.

Next, a positional relationship of each portion of the metal frame 300 and each portion of the fuser 100 will be described in detail.

A gear G2 is rotatably supported by the boss 219 of the resin frame 210. The gear G2 is engaged with a gear G1 which is rotatable integrally with a shaft 131 provided to a left-end portion of the shaft 131 of the pressurizing roller 130. Accordingly, as a driving force is transmitted to the gear G2 from outside, the gear G1 rotates, and the pressurizing roller 130 also rotates with the rotation of the gear G1.

The resin frame 210 includes a bearing supporting portion H1 between the rear portion 211 and the front portion 212, which supports a bearing 132 of the pressurizing roller 130. Moreover, the resin frame 220 includes a bearing supporting portion H2 between the rear portion 221 and the front portion 222, which supports a bearing 132 of the pressurizing roller 130. The bearing 132 supported by the bearing supporting portion rotatably supports the left-end portion of the shaft 131 of the pressurizing roller 130. Moreover, the bearing 132 supported by the bearing supporting portion H2 rotatably supports the right-end portion of the shaft 131 of the pressurizing roller 130. In other words, the pair of bearings 132 rotatably supports the pressurizing roller 130. The bearing 132 may be a roller bearing or a sliding bearing.

The horizontal fixing portion 371 and the horizontal fixing portion 373 of the metal frame 300 are arranged at a downstream side of the conveyance direction of the axis of rotation 131A of the pressurizing roller 130, or in other words, at the rear side. Moreover, the horizontal fixing portion 372 and the horizontal fixing portion 374 are arranged at an upstream side of the conveyance direction of the axis of rotation 131A of the pressurizing roller 130, or in other words, at the front side. Namely, the axis of rotation 131A of the pressurizing roller 130 is positioned between the first fixing portion (horizontal fixing portion 371) and the second fixing portion (the horizontal fixing portion 372), and between the third fixing portion (the horizontal fixing portion 373) and the fourth fixing portion (the horizontal fixing portion 374), in the conveyance direction.

In the present embodiment, the horizontal fixing portion 371 is arranged at a rear side of the bearing supporting portion H1, and the horizontal fixing portion 372 is arranged at a front side of the bearing supporting portion H1. The horizontal fixing portion 373 is arranged at a rear side of the bearing supporting portion H2, and the horizontal fixing portion 374 is arranged at a front side of the bearing supporting portion H2.

Figure 6:
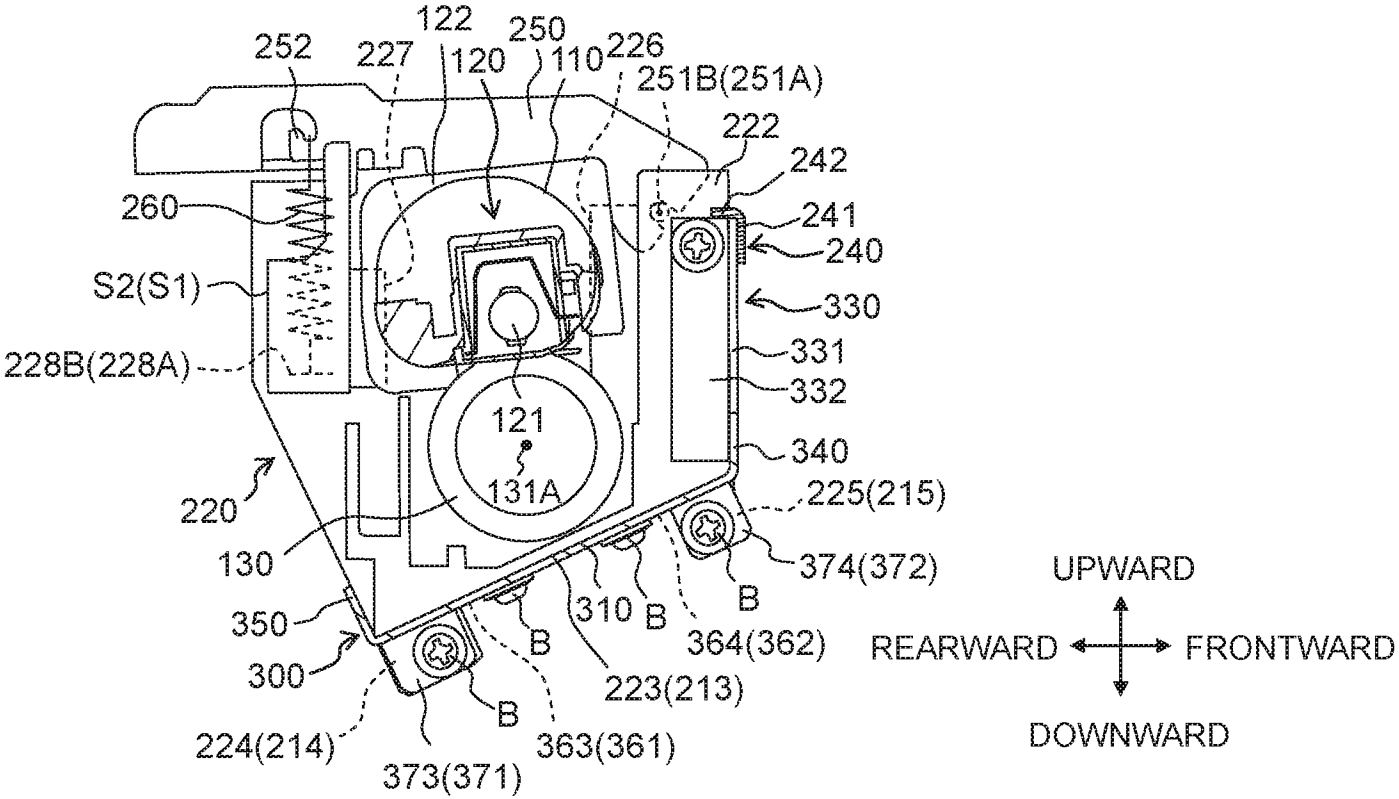
FIG. 6 is a cross-sectional view of the fuser.

As shown in FIG. 6, the vertical fixing portion 361 and the vertical fixing portion 363 of the metal frame 300 are arranged at a rear side of the axis of rotation 131A of the pressurizing roller 130. Moreover, the vertical fixing portion 362 and the vertical fixing portion 364 are arranged at a front side of the axis of rotation 131A of the pressurizing roller 130.

Moreover, the main-body portion 310 of the metal frame 300 is arranged on an opposite side of the fixing belt 110, with respect to the pressurizing roller 130, or in other words, at a lower side of the pressurizing roller 130.

The fuser 100 further includes a holding member 122 which supports the heating unit 120, an arm member 250, and a spring 260.

The holding member 122 is provided to two end portions in the leftward-rightward direction of the heating unit 120. The holding members 122 on the left and right are supported by the resin frame 210 and the resin frame 220 respectively, to be capable of sliding up and down. In FIG. 6, only the holding member 122 on the right side is shown, and an arrangement of the resin frame 210 and the resin frame 220 supporting the holding frame 122 and the holding frame 122 is almost same.

Specifically, the resin frame 210 and the resin frame 220 include a guide portion 226 extended in the vertical direction, which is arranged at a front side of the axis of rotation 131A of the pressurizing roller 130, and a guide portion 227 extended in the vertical direction, which is arranged at a rear side of the axis of rotation 131A of the pressurizing roller 130. Moreover, the holding member 122, by being guided by the guide portion 226 and the guide portion 227, is movable vertically with respect to the resin frame 210 and the resin frame 220.

The arm member 250, as shown in FIG. 5, includes a arm member 250A which is rotatably supported by the resin frame 210 and a arm member 250B which is rotatably supported by the resin frame 220. Moreover, the spring 260 includes a spring 260A which applies a bias to the arm member 250A and a spring 260B which applies a bias to the arm member 250B. In FIG. 6, only the arm member 250 and the spring 260 on the right side are shown, and the arm members 250 (the arm member 250A and the arm member 250B) on the left and right and the springs 260 (the spring 260A and the spring 260B) on the left and right are formed symmetrically, and have almost the same arrangement.

As shown in FIG. 6, the arm member 250 is extended in the frontward-rearward direction at an upper side of the holding member 122. In other words, the arm member 250 is arranged at a side opposite to the pressurizing roller 130, with respect to the fixing belt 110, and is extended in the conveyance direction. Moreover, a front-end portion of the arm member 250 is rotatably supported by the resin frame 210 and the resin frame 220. Specifically, as shown in FIG. 2, the resin frame 210 includes a shaft portion 212A at an upper portion of the front portion 212, which is extended in the leftward-rightward direction, and with which, a front-end portion of the arm member 250A is engaged. Moreover, the resin frame 220 includes a shaft portion 222A at an upper portion of the front portion 222, which is extended in the leftward-rightward direction, and with which, a front-end portion of the arm member 250B is engaged.

Furthermore, the resin frame 210 has a groove 211A in the form of a slit extended downward from an upper end of the rear portion 211, at a portion of the rear portion 211, facing the shaft portion 212A. Moreover, the resin frame 220 has a groove 221A in the form of a slit extended downward from an upper end of the rear portion 221, at a portion of the rear portion 221, facing the shaft portion 222A. A rear-end portion of the arm member 250 is arranged in the groove 211A and a rear-end portion of the arm member 250B is arranged in the groove 221A, and the rear-end portions of each arm member 250 moves up and down along the groove 211A and the groove 211B.

Returning to FIG. 6, the arm member 250, at a rear-end portion thereof, has a hook portion 252 with which one end of the spring 260 is engaged.

The spring 260 has one end thereof engaged with the hook portion 252 of the arm member 250, and the other end thereof engaged with the resin frame 210 and the resin frame 220. Specifically, the resin frame 210, as shown in FIG. 4, has in the rear portion 211, a spring accommodating portion 51 having a cylindrical shape extended in the vertical direction. Moreover, the resin frame 220 has in the rear portion 221, a spring accommodating portion S2 having a cylindrical shape extended in the vertical direction. Furthermore, as shown in FIG. 6, the resin frame 210, at an inner side of the spring accommodating portion 51, has a spring engaging portion 228A with which one end of the spring 260A is engaged. Moreover, the resin frame 220, at an inner side of the spring accommodating portion S2, has a spring engaging portion 228B with which one end of the spring 260B is engaged. The spring engaging portion 228A and the spring engaging portion 228B are provided at positions on a side same as the fixing belt 110 with respect to the main-body portion 310 of the metal frame 300 in the vertical direction, or in other words, at an upper side.

The spring 260 pulls a rear-end portion of the arm member 250 to a lower side. The spring 260 biases the arm member 250 toward the fixing belt 110. Accordingly, the bias is applied to the arm member 250 in a counterclockwise direction of FIG. 6 by the spring 260, and the arm member 250 pushes the holding member 122 downward. In other words, the spring 260, via the arm member 250, applies bias to the fixing belt 110 in a direction of the pressurizing roller 130.

The connecting member 240 is arranged on the side same as the fixing belt 110 with respect to the main-body portion 310 or in other words, an upper side of the main-body portion 310 of the metal frame 300, in the vertical direction. The connecting member 240 is arranged at a position further (distant) from the main-body portion 310 of the metal frame 300 than the pressurizing roller 130, or in other words, an upper side of the pressurizing roller 130, in the vertical direction. Namely, the rotational axis 131A of the pressurizing roller 130 is positioned between the main-body portion 310 and the connecting member 240 in the vertical direction.

More elaborately, the connecting member 240 is arranged at a position further (distant) from the main-body portion 310 of the metal frame 300 than the spring engaging portion 228A and the spring engaging portion 228B, or in other words, a position at an upper side, of the spring engaging portion 228A and the spring engaging portion 228B.

Moreover, the connecting member 240 is provided at a same position as an axis of rotation (pivoting) 251A of the arm member 250A and an axis of rotation (pivoting) 251B of the arm member 250B in the vertical direction. In other words, the connecting member 240 overlaps (coincides) with the axis of rotation 251A of the arm member 250A and the axis of rotation 251B of the arm member 250B when viewed from the frontward-rearward direction.

An action and an effect of the fuser 100 arranged as described above will be explained below.

A portion of the fixing frame 200, arranged on both left and right sides of the pressurizing roller 130, has a complex shape as it has various functions such as having the bearing supporting portion H1 and the bearing supporting portion H2. In the present embodiment, since the resin frame 210 having the bearing supporting portion H1 and the resin frame 220 having the bearing supporting portion H2 are formed of a resin, it is easy to make a complex shape around the bearing supporting portion H1 and the bearing supporting portion H2, as compared to a case in which the frames having the bearing supporting portion H1 and the bearing supporting portion H2 are formed of a metal. Moreover, since the resin frame 210 and the resin frame 220 are connected to the metal frame 300, it is possible to suppress a deformation of the fixing frame 200, such as twisting of the resin frame 210 and the resin frame 220. Moreover, since a component made of resin is smaller as compared to a case in which the entire fixing frame 200 is formed of a resin, it is possible to suppress a damage caused at the time of forming, and to suppress a dimensional error from becoming large.

Moreover, by fixing the reinforcing portion 320 and the reinforcing portion 330 of the metal frame 300 to the resin frame 210 and the resin frame 220, it is possible to regulate a distance in the leftward-rightward direction of (between) the resin frame 210 and the resin frame 220, by the metal frame 300. Furthermore, the reinforcing portion 320 and the reinforcing portion 330 are integrated with the main-body portion 310, and are a portion of the metal frame 300. As compared to a case of providing the reinforcing portion 320 and the reinforcing portion 330 as components separate from the metal frame 300, it is possible to reduce the number of components and to make small an error in distance in the leftward-rightward direction of (between) the resin frame 210 and the resin frame 220.

Moreover, since the metal frame 300 has the front reinforcing portion 340 at the front-end portion of the main-body portion 310 and a rear reinforcing portion 350 at the rear-end portion of the main-body portion 310, it is hard to be bent. Therefore, it is possible to suppress further the deformation of the fixing frame 200, such as the twisting of the resin frame 210 and the resin frame 220.

Moreover, the fixing frame 200 includes the connecting member 240 made of a metal, which is arranged on the side same as the fixing belt 110 with respect to the main-body portion 310 in the vertical direction, and which connects the resin frame 210 and the resin frame 220. Consequently, it is possible to suppress the resin frame 210 and the resin frame 220 from falling over to an inner side or an outer side of the leftward-rightward direction. In other words, it is possible to suppress the fixing frame 200 from falling over to a side in which the resin frame 210 and the resin frame 220 come mutually closer in the leftward-rightward direction (inner side of the leftward-rightward direction) or a side in which the resin frame 210 and the resin frame 220 are mutually separated apart (outer side of the leftward-rightward direction).

Moreover, the connecting member 240 is arranged at a position further from the main-body portion 310, than the spring engaging portion 228A and the spring engaging portion 228B in the vertical direction, and connects the resin frame 210 and the resin frame 220 at a position away from the main-body portion 310. Consequently, it is possible to suppress the resin frame 210 and the resin frame 220 from falling over to the inner side in the leftward-rightward direction.

Moreover, a force from the arm member 250A is applied to the front portion 212 of the resin frame 210, which supports the arm member 250A. A force from the arm member 250B is applied to the front portion 222 of the resin frame 220, which supports the arm member 250B. In the present embodiment, since the connecting member 240 is provided at the same position as the axis of rotation 251A of the arm member 250A and the axis of rotation 251B of the arm member 250B in the vertical direction, and connects the front portion 212 and the front portion 222, it is possible to suppress the deformation of the front portion 212 and the front portion 222.

Furthermore, since the connecting member 240 is formed to be L-shaped including the plate portion 241 and the plate portion 242 which faces the vertical direction differing from the plate portion 241, the connecting member 240 is hard to be bent. Consequently, when the resin frame 210 and the resin frame 220 are about to fall over to the inner side of the leftward-rightward direction, since it is possible to support firmly the resin frame 210 and the resin frame 220 by the connecting member 240, it is possible to further suppress the resin frame 210 and the resin frame 220 from falling over to the inner side of the leftward-rightward direction.

Moreover, since the reinforcing portion 320 and the reinforcing portion 330 which connect the connecting member 240 and the main-body portion 310 of the metal frame 300 have been provided, it is possible to reinforce the main-body portion 310 and the connecting member 240 by the reinforcing portion 320 and the reinforcing portion 330. Accordingly, it is possible to suppress the deformation of the fixing frame 200, such as the twisting of the resin frame 210 and the resin frame 220, and falling over of the resin frame 210 and the resin frame 220 to the inner side of the leftward-rightward direction.

Since the metal frame 300 has the horizontal fixing portion 371 and the horizontal fixing portion 372 fastened by the screws to the resin frame 210 in the leftward-rightward direction, it is possible to suppress by the metal frame 300, the resin frame 210 from rotating around an axis extended in the vertical direction as a center. Moreover, since the metal frame 300 has the horizontal fixing portion 373 and the horizontal fixing portion 374 fastened by the screws to the resin frame 220 in the leftward-rightward direction, it is possible to suppress by the metal frame 300, the resin frame 220 from rotating around an axis extended in the vertical direction as a center.

Moreover, since the metal frame 300 has the vertical fixing portion 361 and the vertical fixing portion 362 fastened by the screws to the resin frame 210 in the vertical direction, it is possible to suppress by the metal frame 300, the resin frame 210 from rotating around an axis extended in the leftward-rightward direction as a center, and from moving in the vertical direction. Moreover, since the metal frame 300 has the vertical fixing portion 363 and the vertical fixing portion 364 fastened by the screws to the resin frame 220, it is possible to suppress by the metal frame 300, the resin frame 220 from rotating around an axis extended in the leftward-rightward direction as a center, and from moving in the vertical direction.

The embodiment of the present teaching has been described above. However, the present teaching is not limited to the embodiment described above. Regarding the specific arrangements, it is possible to make appropriate modifications without departing from the scope of the present teaching. Same reference numeral will be assigned to components that are similar as in the embodiment described above, and description such components will be omitted.

Figure 7:
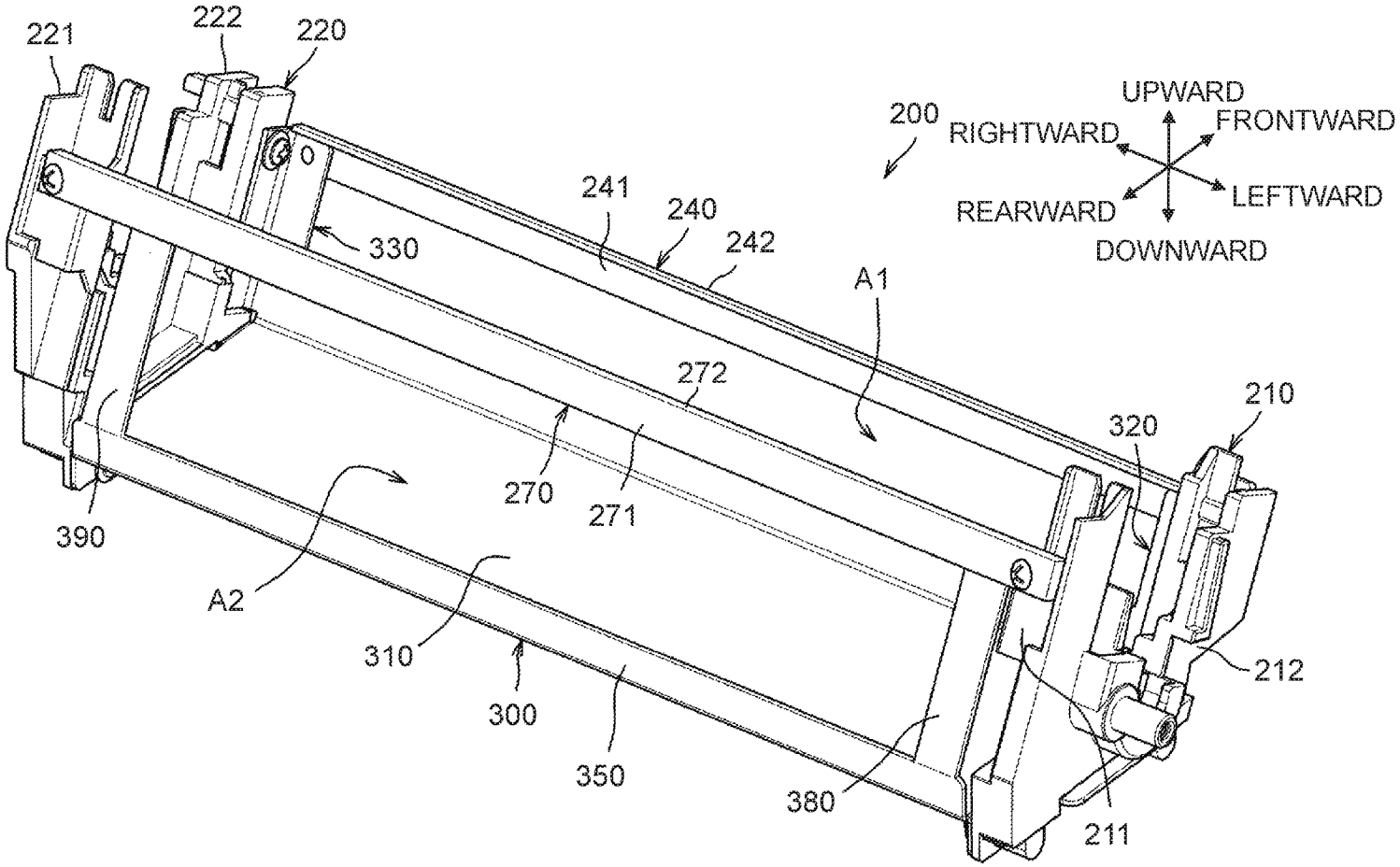
FIG. 7 is a perspective view showing a modified example of the fixing frame.

In the embodiment, the reinforcing portion 320, the reinforcing portion 330, and the connecting member 240 have been provided only to the upstream side of the conveyance direction of the resin frame 210 and the resin frame 220. However, an arrangement of the first reinforcing portion, the second reinforcing portion, and the connecting member is not restricted to the abovementioned arrangement. For instance, as shown in FIG. 7, a reinforcing portion 380, a reinforcing portion 390, and a connecting member 270 may be provided also to the downstream side of the conveyance direction of the resin frame 210 and the resin frame 220. The reinforcing portion 380 is an example of the first reinforcing portion, and the reinforcing portion 390 is an example of the second reinforcing portion.

Specifically, the connecting member 270 on the downstream side connects upper end portions of the rear portion 211 of the resin frame 210 and the rear portion 221 of the resin frame 220. The connecting member 270 includes a plate portion 271 which faces the frontward-rearward direction, and is extended in the leftward-rightward direction, and a plate portion 272 which faces the vertical direction differing from the plate portion 271, and is extended frontward from an upper end of the plate portion 271. Moreover, the connecting member 270 has a left-end portion of the plate portion 271 fastened by a screw to the rear portion 211, and a right-end portion of the plate portion 271 fastened by a screw to the rear portion 221. In other words, the connecting member 270 is fixed directly to the resin frame 210 and the resin frame 220, and connects the resin frame 210 and the resin frame 220. Accordingly, in this modified example, it is possible to regulate a distance in the leftward-rightward direction of (between) the resin frame 210 and the resin frame 220 by the connecting member 270.

In such manner, by providing the connecting member 270 also to the downstream side of the conveyance direction of the resin frame 210 and the resin frame 220, it is possible to further suppress the deformation of the fixing frame 200.

Moreover, the rear portion 211 is provided with the spring engaging portion 228 and the rear portion 221 is provided with the spring engaging portion 228B, and a force is applied to each by the spring 260. By providing the connecting member 270 to the rear portion 211 and the rear portion 221, it is possible to suppress the deformation of the rear portion 211 and the rear portion 221.

Moreover, the reinforcing portion 380 on the downstream side connects the left-end portion of the main-body portion 310 and a left-end portion of the connecting member 270. Specifically, the reinforcing portion 380 is extended upward continuously from a left-end portion of the rear reinforcing portion 350, and an upper-end thereof is fixed to the left-end portion of the plate portion 271 of the connecting member 270 by caulking, or by welding, or by fastening by a screw.

The reinforcing portion 390 on the downstream side connects the right-end portion of the main-body portion 310 and a right-end portion of the connecting member 270. Specifically, the reinforcing portion 390 is extended upward continuously from a right-end portion of the rear reinforcing portion 350, and a right-end thereof fixed to the right-end portion of the plate portion 271 of the connecting member 270 by caulking, or by welding, or by fastening by a screw.

Moreover, by the main-body portion 310 (more elaborately, the rear reinforcing portion 350), the connecting member 270, the reinforcing portion 390, and the reinforcing portion 380 on the downstream side, a space A2 enclosed by the main-body portion 310, the connecting member 270, the reinforcing portion 390, and the reinforcing portion 380 on the downstream side is formed. The paper P passing through the fixing belt 110 and the pressurizing roller 130 can pass through the space A2.

In the embodiment described above, the connecting member 240 has been provided at the same position as the axis of rotation 251A of the arm member 250A and the axis of rotation 251B of the arm member 250B, in the vertical direction. However, a position for providing the connecting member 240 is not restricted to the abovementioned position. For instance, the connecting member 240 may have been arranged at a position further from main-body portion 310 than the axis of rotation 251A of the arm member 250A and the axis of rotation 251B of the arm member 250B, in the vertical direction, or at a position on the upper side. Namely, the axes of rotation 251A, 251B of the arm members 250A, 250B may be arranged between the main-body portion 310 and the connecting member 240, in the vertical direction.

In the embodiment described above, the metal frame 300 had four vertical fixing portions 361, 362, 363, and 364, and four horizontal fixing portions 371, 372, 373, and 374 as examples of the first fixing portion, the second fixing portion, the third fixing portion, and the fourth fixing portion. However, an arrangement of the first fixing portion, the second fixing portion, the third fixing portion, and the fourth fixing portion is not restricted to the abovementioned arrangement. For instance, the metal frame 300 may have only four vertical fixing portions 361, 362, 363, and 363, or may have only four horizontal fixing portions 371, 372, 373, and 374, as the first fixing portion, the second fixing portion, the third fixing portion, and the fourth fixing portion.

In the embodiment described above, the four vertical fixing portions 361, 362, 363, and 364 and the four horizontal fixing portions 371, 372, 373, and 374 of the metal frame 300 have been fixed to the resin frames 210 and 220 by fastening by screws. However, a method of fixing to the metal frame is not restricted to the abovementioned method. For instance, the four vertical fixing portions 361, 362, 363, and 364 and the four horizontal fixing portions 371, 372, 373, and 374 may have been fixed to the resin frames 210 and 220 by caulking or by hooking a claw portion.

In the embodiment described above, the metal frame 300 had the reinforcing portion 320 and the reinforcing portion 330, and the reinforcing portion 320 and the reinforcing portion 330 were extended from the main-body portion 310. However, an arrangement of the first reinforcing portion and the second reinforcing portion is not restricted to the abovementioned arrangement. The first reinforcing portion and the second reinforcing portion may be metal components provided separately from the metal frame 300, and may have been fixed to the metal frame 300 and the connecting member 240 by caulking or by screws.

In the embodiment described above, the connecting member 240 has been formed as a component separate from the metal frame 300. However, an arrangement of the connecting member is not restricted to the abovementioned arrangement. For instance, the connecting member may have been provided integrally with the metal frame.

In the embodiment described above, the fuser 100 included the fixing belt 110 as the rotating body, and the pressurizing roller 130 as the roller. However, an arrangement of the fuser is not restricted to such arrangement. For instance, the fuser may include a pressurizing belt made of an endless belt, as the rotating body, and a heating roller which is heated by a heater, as the roller, or may include a pressurizing roller as the rotating body, and the heating roller which is heated by the heater, as the roller.

Moreover, it is possible to combine arbitrarily the components of the embodiments and modified examples described above, and to put into operation.

What is claimed is:

1. A fuser comprising:

a rotating body;

a roller having a rotational axis extended in an axial direction, configured to convey a sheet in a conveyance direction which is perpendicular to the axial direction in a state of nipping the sheet between the rotating body and the roller;

a pair of bearings supporting the roller;

one side frame made of a resin, supporting one of the pair of bearings;

another side frame supporting the other of the pair of bearings, and arranged at a distance from the one side frame in the axial direction; and a center frame made of a metal, including a main-body portion arranged on an opposite side of the rotating body with respect to the roller, wherein one end portion in the axial direction of the main-body portion includes a first fixing portion which is fixed to the one side frame, and a second fixing portion which is arranged on an upstream side of the first fixing portion in the conveyance direction, and is fixed to the one side frame.

2. The fuser according to claim 1, wherein the rotational axis of the roller is positioned between the first fixing portion and the second fixing portion in the conveyance direction.

3. The fuser according to claim 1, further comprising:

a connecting member made of a metal, arranged on a side same as the rotating body with respect to the main-body portion, in an alignment direction which is a direction perpendicular to the axial direction and the conveyance direction, and connecting the one side frame and the other side frame.

4. The fuser according to claim 3, wherein the rotational axis of the roller is positioned between the main-body portion and the connecting member in the alignment direction.

5. The fuser according to claim 3, further comprising:

a first reinforcing portion connecting one end portion, in the axial direction, of the main-body portion and one end portion, in the axial direction, of the connecting member; and a second reinforcing portion connecting the other end portion, in the axial direction, of the main-body portion, and the other end portion, in the axial direction of the connecting member.

6. The fuser according to claim 5, wherein the center frame includes the first reinforcing portion and the second reinforcing portion, and the first reinforcing portion and the second reinforcing portion are extended continuously from the main-body portion.

7. The fuser according to claim 5, wherein the first reinforcing portion is fixed to the one side frame and the second reinforcing portion is fixed to the other side frame.

8. The fuser according to claim 5, wherein the roller is configured to convey the sheet through a space enclosed by the first reinforcing portion, the second reinforcing portion, the connecting member, and the main-body portion.

9. The fuser according to claim 3, further comprising:

a spring biasing the rotating body toward the roller, wherein the one side frame includes an engaging portion with which one end of the spring is engaged, and the engaging portion is arranged between the main-body portion and the connecting member in the alignment direction.

10. The fuser according to claim 3, further comprising:

an arm member rotatably supported by the one side frame; and a spring biasing the arm member toward the rotating body, wherein an axis of rotation of the arm member is arranged at a same position as the connecting member, or between the main-body portion and the connecting member, in the alignment direction.

11. The fuser according to claim 3, wherein the connecting member includes a first plate portion having a rectangular shape which is extended in the axial direction, and a second plate portion having a rectangular shape which is extended in the axial direction, and one of long sides of the first plate portion and one of long sides of the second plate portion are connected, and a pair of short sides of the first plate portion and a pair of short sides of the second plate portion are extended in mutually different directions.

12. The fuser according to claim 11, wherein a direction in which the pair of short sides of the first plate portion is extended is perpendicular to a direction in which the pair of short sides of the second plate portion is extended.

13. The fuser according to claim 1, wherein the main-body portion has a surface facing the roller, and the center frame further includes a reinforcing portion which is extended from at least one of both end portions in the conveyance direction of the surface of the main-body portion, toward a side same as the roller with respect to the surface of the main-body portion.

14. The fuser according to claim 13, wherein the reinforcing portion is provided to each of the end portions in the conveyance direction of the surface of the main-body portion.

15. The fuser according to claim 13, wherein the reinforcing portion has a plate shape and is extended in the axial direction along at least one of the end portions in the conveyance direction of the surface of the main-body portion.

16. The fuser according to claim 1, further comprising:

a connecting member made of a metal, arranged on a side same as the rotating body with respect to the main-body portion in an alignment direction which is a direction perpendicular to the axial direction and the conveyance direction, and connecting the one side frame and the other side frame, wherein the center frame further includes a first reinforcing portion which connects one end portion in the axial direction of the main-body portion and one end portion in the axial direction of the connecting member, a second reinforcing portion which connects the other end portion in the axial direction of the main-body portion and the other end portion in the axial direction of the connecting member, and a third reinforcing portion which is extended from one end portion in the conveyance direction of the main-body portion, toward a side same as the roller with respect to the main-body portion, and which connects the first reinforcing portion and the second reinforcing portion.

17. The fuser according to claim 16, wherein the main-body portion, the first reinforcing portion, the second reinforcing portion, and the third reinforcing portion are integrally formed.

18. The fuser according to claim 1, wherein each of the first fixing portion and the second fixing portion is extended orthogonal to the axial direction from the main-body portion, and is fastened by a screw to the one side frame in the axial direction.

19. The fuser according to claim 1, wherein each of the first fixing portion and the second fixing portion is fastened by a screw to the one side frame, in a direction directed from the roller toward the rotating body.

20. The fuser according to claim 1, wherein the other side frame is made of a resin.

* * * * *